United States Patent [19]

Fitch et al.

[11] 4,236,900

[45] Dec. 2, 1980

[54] ELECTROSTATIC PRECIPITATOR APPARATUS HAVING AN IMPROVED ION GENERATING MEANS

[75] Inventors: Richard A. Fitch, La Jolla; James E. Drummond, Coronado; Alfred A. Mondelli, Del Mar, all of Calif.

[73] Assignee: Maxwell Laboratories, Inc., San Diego, Calif.

[21] Appl. No.: 891,826

[22] Filed: Mar. 30, 1978

Related U.S. Application Data

[63] Continuation-in-part of Ser. No. 877,123, Feb. 13, 1978, abandoned, which is a continuation of Ser. No. 754,236, Dec. 27, 1976, abandoned.

[51] Int. Cl.[2] ..... B03C 3/12; B03C 9/02

[52] U.S. Cl. ..... 55/138; 55/139; 55/151; 55/152; 55/153; 55/154

[58] Field of Search ..... 55/2, 102, 136–138, 55/139, 146, 148, 151, 152, 153, 154; 361/225, 226, 230

[56] References Cited

U.S. PATENT DOCUMENTS

| | | | |
|---|---|---|---|
| 617,618 | 1/1899 | Thwaite | 55/152 |
| 1,357,201 | 10/1920 | Nesbit | 55/152 |
| 1,357,466 | 11/1920 | Muller | 55/2 |
| 2,142,128 | 1/1939 | Hoss et al. | 55/2 |
| 2,377,391 | 6/1945 | White | 55/2 |
| 2,440,455 | 4/1948 | White | 55/2 |
| 3,120,626 | 2/1964 | Schweriner | 361/230 |
| 3,178,930 | 4/1965 | Moore et al. | 55/136 |

*Primary Examiner*—Frank Sever

*Attorney, Agent, or Firm*—Fitch, Even, Tabin, Flannery & Welsh

[57] ABSTRACT

A multi-stage system is disclosed for removing particles from a gaseous medium and comprises an upstream precipitating stage of spaced corona discharging wires between parallel collecting plates, followed by a downstream precipitating stage having one or more electrically charged shells with flat sides generally parallel to collecting side plates for providing a uniform electric field in the medium carrying space, the sides of the shell having openings through which ions generated in the interior pass into the gaseous medium. A corona discharge apparatus inside the shell produces the ions at predictable, generally uniformly spaced locations. Alternative embodiments of the system include another stage located ahead of the upstream stage for removing the larger particles in the gaseous medium which can comprise a gravitational precipitator, a cyclone separator, a low voltage electrostatic precipitator or a low voltage ion beam generator. A further embodiment of the system includes a downstream electrostatic precipitator stage for recharging and removing particles which may become reentrained in the gaseous medium after initial collection thereof.

37 Claims, 10 Drawing Figures

ELECTROSTATIC PRECIPITATOR APPARATUS HAVING AN IMPROVED ION GENERATING MEANS

This application is a continuation-in-part application of our continuation application, Ser. No. 877,123, filed Feb. 13, 1978 now abandoned, which is a continuation of parent application Ser. No. 754,236, filed Dec. 27, 1976 now abandoned.

The present invention generally relates to the field of electrostatic precipitation apparatus for removing dust and other particles from a gaseous medium, such as industrial flue gases and other effluents.

Electrostatic precipitators have been among the many devices that have been developed for removing air-borne dust and other particles from a gaseous medium prior to the discharge of the medium into the atmosphere. These precipitators typically remove particles from the gaseous medium by passing it through a chamber in which ions are generated by a corona discharge. The ions collide and combine with the dust particles and electrically charge the particles as they pass through the chamber. Additionally, the electric field associated with the generation of ions within the collection chamber exerts a force upon the charged dust particles and drives them toward a collection plate or electrode that has an applied potential of opposite polarity relative to the charged particles. Desirably, most dust particles will become charged and collected on the collection plate so that the gaseous medium that is discharged into the atmosphere will have been well cleaned.

In the operation of most prior art electrostatic precipitators as well as the invention described herein, dust particles which combine with ions take on the same charge as the ions. When a dust particle becomes charged and has the same charge as the ion, other ions of the same sign are repelled by it, thereby making it more difficult for others ions of the same sign to add electrical charges to the particle. For a given electrostatic field strength and a given size of dust particle there will be a limit beyond which the dust particle will no longer accept additional charges by field charging. A maximum charge which can be acquired by dust particles in field charging is $N_s$ given by the equation $$N_s=(52\ \epsilon\ ED^2)/(\epsilon+2)$$

wherein $N_s$ is the saturation number of electronic charges, E is the applied electric field in kV per centimeter, D is the particle diameter in microns and $\epsilon$ is the particle dielectric constant.

The above equation indicates the charge limit of both large and small diameter dust particles is essentially a function of the electric field strength. It is apparent that it is desirable to increase the electric field to the point at which most particles will be sufficiently charged so that they will be collected on a collection plate or electrode and not be expelled into the atmosphere, it being understood that it is extremely difficult to collect all particles, due to turbulence and other factors. However, in conventional electrostatic precipitators, the average electric field within the collection chamber is generally limited to about 4 kV/cm because of the manner in which the ions are generated. Typically such precipitators include a corona discharge device within the collection chamber for generating the ions with the corona discharge being produced by a high potential applied to an electrode such as a thin wire. As a result, the collection chamber generally experiences a highly nonuniform electric field that has a low average value. The low average value for the electric field within the collection chamber is undesirable because it limits the degree to which particles within the chamber can be effectively charged and reduces their drift velocity towards the collecting plates.

However, U.S. patents to Alan C. Kolb and James E. Drummond, U.S. Pat. Nos. 4,071,334 and 4,070,157 entitled A Method and Apparatus for Precipitating Particles from a Gaseous Effluent, which are assigned to the same assignee as the present invention, each disclose a precipitation apparatus which has a generally high uniform electric field within the charging chamber and ions generated by independent means, such as a thermionic ion emitter or an electron beam generator, the latter of which is sealed from the main charging chamber and directs a beam of electrons into the charging chamber for ionizing molecules therein and for charging the dust particles within the gaseous effluent.

The independent generation of the ions by means other than that which produces the electric field enables a stronger, more uniform electric field to be established within the apparatus and permits independent control over the ions that are generated to produce the charging of the particles of the effluent that is to be cleaned. While the apparatus disclosed in the above-referenced Kolb and Drummond patent represents significant improvements over the type of apparatus that utilizes a thin wire or the like for creating both the corona discharge and establishing the electric field in the device, such apparatus charges the particles and also subjects the charged particles to an electric field to force them onto a collector plate in the same chamber. The electrical force is directly proportional to the charge of the particle and the strength of the collecting field, $E_{coll}$, and the charge on the particle is directly proportional to the strength of the field in which the particle is charged, $E_{ch}$. Thus the force, and hence the effectiveness of the system, is proportional to the product of the two field strengths, i.e., $$F \propto E_{coll} \times E_{ch}$$

While it is desirable to makeboth of these fields as high as possible, there are two distinct problems that are generally experienced; the charging field must be suffused with a supply of ions to effect charging and a high field at the collector plate tends to pull the dust particles off of the plate and reentrain them. This is due to the fact that after the dust particle lands, it gives up its charge and is recharged with the opposite polarity so that it acquires a reverse force. In conventional wire plate precipitator apparatus, both problems are solved simultaneously by the corona discharge wire which provides the ions for charging the air-borne particles and also provides a continuous supply of ions at the collected dust layer to inhibit reentrainment by maintaining a charge of the original sign, which may be referred to as the pin-on current. However, the disadvantage of the arrangement is that of experiencing reduced electric fields, both $E_{ch}$ and $E_{coll}$, because the corona process necessitates a highly nonuniform field and a nonuniform field exhibits spark breakdown at lower average field strengths than a uniform field.

Spark breakdown generally sets the limit of the maximum practical electric field in that, as the field is increased, the probability of sparking also increases so that at some point sporadic sparking sets in, at a rate that increases as the field continues to increase, until it becomes so frequent that the time-average field declines or the power demands of the apparatus become prohibitive. Generally, the electric field of modern conventional electrostatic preciptators is kept at a point where sparking occurs at the rate of about one spark per second.

In a perfectly uniform electric field, under clean conditions, at room temperature, and sea level pressure, with only natural background ionization, the breakdown limit is generally well recognized to be at about 30 kV/cm. Many factors, including the increase in temperature, the reduction in pressure, the presence of dirt, the increased ion densities and increased nonuniformity, all lower the breakdown strength as well as increase its spread. Typical precipitator conditions comprise a temperature of about 350° F., 15 to 21 inches (water pressure reduction and the presence of dust, all of which are unavoidable and which lower the uniform field, ion-free breakdown to a level of about 17 kV/cm. The addition of ions and the intrinsic field nonuniformity of a conventional wire/plate precipitator lower the mean field strength still further to a level of about 4–5 kV/cm.

The use of a single stage for charging and collecting the particles has been generally felt to be superior to two stage arrangements which charge the particles in a first corona stage and collect them in a second non-corona stage, probably because of the problem of back corona in the first stage and dust reentrainment in the second which can be extensive in prior two stage arrangements (e.g. see pp. 34–35 in the textbook "Industrial Electrostatic Precipitation" by H. J. White, 1963).

From the foregoing discussion of the many phenomena that need to be taken into consideration in removing particles from a gaseous effluent, together with many problems that are experienced with conventional electrostatic precipitators, including single stage and two stage arrangements, it should be apparent that precipitating apparatus that operates to remove particles with the efficiency that may be required by governmental regulations has heretofore been difficult to attain at a reasonable cost and using a reasonable amount of physical space.

The present invention can be broadly summarized as a system in which multiple stages are utilized, with each stage performing a primary function and the multiple stages operating synergistically to provide significantly improved overall results. The present invention utilizes an upstream stage comprised of a generally conventional electrostatic precipitator apparatus of the type utilizing a series of corona discharge wires and accompanying parallel collector plates, followed by a downstream stage which incorporates an improved ion generating means that provides a sufficient ion current density as well as a generally uniform electric field, in the manner whereby each can be generally independently controlled at the appropriate level. Moreover, the downstream region effectively charges the particles that are either uncollected or reentrained and collects those particles after they have been charged.

Accordingly, it is an object of the present invention to provide an improved multi-stage precipitating apparatus which utilizes an improved ion generating means for introducing unipolar ions into the gaseous effluent and for generating a uniform electric field in the region between the collector plate structure and the ion generating means where the medium is flowing through.

A further object of the present invention is to provide a multi-stage precipitating apparatus wherein the downstream region has a high uniform electric field and wherein the ion current density in the downstream region can be sufficiently small to control back corona without any penalty in the reduction of the average field and still be sufficient to hold collected particles to the collecting plate structure prior to removal of the particles from the collecting plate structure.

Another object of the present invention is to provide an improved precipitating apparatus which incorporates an ion generating means that has an improved corona discharge apparatus within it.

Still another object of the present invention is to provide an improved precipitating apparatus that includes a downstream region that utilizes an improved ion generating means which with the precipitating apparatus achieves superior operating results in terms of power efficiency and overall particle removal from the gaseous medium.

A further object of the invention is to provide a multi-stage precipitating apparatus that may include an upstream precipitator stage designed for removing the larger particles from the gaseous medium.

A further object of the present invention is to provide a multi-stage precipitating apparatus that may include a gravitational pre-precipitator stage upstream of an electrical precipitating region.

A further object of the invention is to provide a multi-stage precipitating apparatus which may include a final downstream electrostatic precipitator stage for recharging and removing particles which may be reentrained in the gaseous medium after initial collection thereof in an upstream precipitator stage.

A further object of the present invention is to provide novel means for reducing back corona in localized areas within precipitating apparatus of the above type.

A still further object of the present invention is to provide a multi-stage precipitating apparatus which has a high efficiency and occupies a minimum physical space.

Other objects and advantages will become apparent upon reading the following detailed description while referring to the attached drawings, in which.

Figure 1:
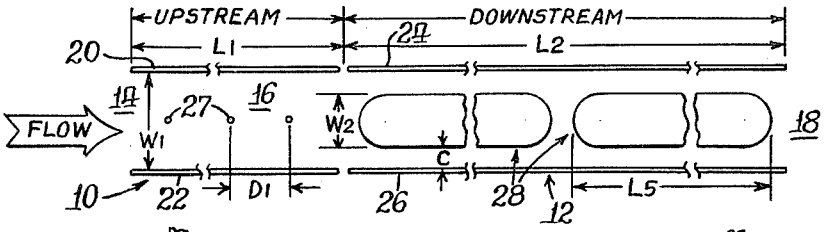
FIG. 1 is a simplified schematic plan view of precipitating apparatus embodying the present invention.

Turning now to the drawings, and referring particularly to FIG. 1, apparatus embodying the present invention is shown in a simplified schematic top plan view as comprising an upstream region indicated generally at 10 and a downstream region indicated generally at 12, with the upstream region having a length L1 and the downstream region a length L2. The gaseous medium enters an inlet 14 shown at the left of the drawing with the flow being to the right as shown by the arrow. The medium passes through the inlet and into the channel indicated generally at 16 which extends the entire length of the apparatus to the outlet indicated at 18. The portion of the apparatus shown in FIG. 1 exemplifies but a single channel within a precipitating apparatus and a typical commercial apparatus would have a large number of such channels arranged parallel to one another, with the side plates of one channel being common to the next adjacent channels.

More specifically, the upstream region has side collecting plates 20 and 22 and the downstream region has side collecting plates 24 and 26. The collecting plates 20 and 24 are preferably coplanar as are collecting plates 22 and 26 so that the width of the channel is generally constant throughout its length. While it is convenient to have the collecting plates of the upstream region generally coplanar with the respective collecting plates of the downstream region, it should be understood that this relationship is not necessary. For example, since the flow path in the downstream region is more restricted due to the presence of an ion generating means, the upstream region may conveniently be narrower if desired. It should also be understood that there need not be a well defined one-to-one relation of channels between the upstream and downstream regions, and that there may be three or four parallel side collecting plates in the upstream region (with intermediate corona wires between adjacent plates as shown in FIG. 1) within the width of two adjacent channels of the downstream region, for example. The collecting plates 20 and 24, as well as collecting plates 22 and 26 may have a space between them as shown or they may be abutting, particularly if they are provided with the same potential which is preferably ground potential as will be described herein.

In a commercial apparatus in the precipitation of fly ash, the apparatus may have an overall height of 30 feet or more, an overall length of about 5 feet to about 50 feet and a sufficient number of channels 16 to provide an overall width of 60 feet or more, with each of the channels having a width W1 of approximately 9 inches. While a commercial fly ash precipitator may have the above-mentioned dimensions, the constituency of other media may enable the dimensions of the apparatus to be considerably altered. In fact, the apparatus may be reduced in scale to the extent that it may be applicable to clean air in a home and may fit within a window of a house or apartment, for example. As the medium flows through the upstream region 10, it is relatively unencumbered by any physical structure within the channel 16, but encounters one or more ion generating means 28 within the downstream region and the medium must divide and flow between the ion generating means 28 and the collecting plates 24 and 26 through the remainder of the length of the channel 16. As should be appreciated, the volume of the channel in the downstream region is thereby reduced by the presence of the ion generating means 28, which means that the flow velocity will increase in this region relative to the flow velocity in the upstream region. For example, in a commercial fly ash precipitator, the flow velocity in the upstream region is within the range of about 3 to 10 feet/sec. and the velocity in the downstream region is approximately double the velocity in the upstream region.

Within the upstream region are one or more vertically oriented conventional corona discharge wires 27 which are charged relative to the collecting plates 20 and 22 and provide a corona discharge in the upstream region that charges the particles of the gaseous medium entering the upstream region. The distance D1 between adjacent corona discharge wires is preferably about 8 to 10 inches and the wires are preferably centrally located within the channel 16 so that the distance between the wires and each of the side collecting plates 20 and 22 is about 4½ inches, given the width W1 of about 9 inches. The corona discharge wires 27 are preferably charged to provide a mean electric field strength of about 4 kV/cm and the overall length L1 of the upstream region may be from about 3 to about 10 feet in a typical fly ash precipitating apparatus. The wires are fully exposed to the corrosive environment of the medium and should therefore be of a size that will permit them to survive without breaking in a short time, i.e., they should preferably have a diameter of about 1/10 to about ⅛ inch. The purpose of the upstream region is to electrostatically precipitate the larger particles, i.e., those particles having a diameter larger than about 10 microns, although it is the particles above about 50 microns that are of prime concern in this region. Another important aspect is to remove the bulk of the particles which would otherwise produce space charge field distortion and thereby lower the average field and which would also quickly build a heavy layer of dust in the relative narrow downstream region were it not removed in the upstream region. The desirability for this derives from the fact that electrical as well as wind reentrainment become a more severe problem as the dust layer becomes heavier and builds up on side collecting plates 24 and 26 of the downstream region 12. Increased reentrainment due to wind occurs in the downstream region because the flow velocity is greater in the downstream region due to the presence of the ion generating means. Also, as the dust particles accumulate, the cross sectional area of the channel is further reduced, which further increases the flow velocity and increases the tendency for the particles to reentrain. This upstream removal of the larger particles is also believed to be helpful for the reason that they are more susceptible to bouncing through the precipitator apparatus and tend to create havoc with the accumulated precipitated dust layer upon impact. When they strike the surface they will dislodge other particles that have accumulated on the side collection plates 24 and 26 and will dislodge both large and small particles alike. By utilizing the upstream region to remove the larger particles, they will be less likely to be present in the downstream region and therefore will not produce this undesirable effect.

As will be hereinafter discussed, a modification of the present invention will provide other means for removing these large particles ahead of the upstream region which will further reduce the probability of their presence in the downstream region. In this regard, it should be appreciated that in typical fly ash precipitators, for example, the mean electric field strength in the upstream region is preferably about 4 kV/cm and that the electric field in the downstream region is significantly higher, and may be in the range of about 6 to about 12 kV/cm which would provide a much stronger influence on such larger particles than is present in the upstream region.

As is apparent from viewing FIG. 1, the collecting region 12 is shown to have two ion generating means 28 in series located centrally within the channel 16. As will be hereinafter described in detail, the ion generating means may comprise a single structure rather than the two in-line structures 28, but for reasons of weight and ease of fabrication and installation, the downstream region may comprise several ion generating means of lengths within the range of about 2 to about 12 feet. The requisite number of them can then be placed in the downstream region to provide the necessary overall length L2 of the downstream region, which may be 10 feet or more. In the event the height of the collecting region does approach 30 feet, then two or more of the ion generating means 28 of correspondingly shorter height may be provided in the apparatus. The width W2 of the ion generating means is preferably as small as possible consistent with achieving the ion current density appropriate to the particular dust to be collected. In the collection of fly ash the width W2 may be about $3\frac{1}{2}$ inches. With a width W2 of about $3\frac{1}{2}$ inches, in an overall channel width W1 of about 9 inches, the spacing between the side walls of the ion generating means 28 and the collecting plates 24 or 26 will be about $2\frac{3}{4}$ inches, generally in the range of between about 1 to about 4 inches, designated as the distance c in FIG. 1 as well as FIG. 3. The above mentioned dimensions are generally applicable for fly ash precipitators. For other applications, the dimensions may be larger or considerably smaller as previously mentioned.

The outer surface of the ion generating means 28 is shown to be smooth in that it has no sharp edges that can provide electric field maxima, since the outer surface is provided with a high voltage relative to the collecting side plates 24 and 26 so as to impart the high uniform electric field previously briefly discussed. For a typical power station which emits fly ash at about 350° F. the uniform electric field between the ion generating means 28 and the side collecting plates 24 and 26 is preferably at least about 6 kV/cm and may approach 12 kV/cm without experiencing significant electrical breakdown. The problem that is generally experienced is the phenomenon of back corona and the electrical field as well as the charging current may be further increased if means are provided for reducing back corona, some of which will be described hereinafter. By having the outer surface of the ion generating means smooth without sharp corners, i.e., providing a radius to all openings that are present, the average field strength within the channel can substantially approach the peak field strength of the apparatus as is desired.

It should also be understood that the collecting plates should be smooth and without sharp corners anywhere opposing the ion generating means. In this regard, it is noted that the minimum distance is the distance c between the surface of the ion generating means and the collecting plates 24 and 26 and that the outer surface of the generating means 28 and the collecting plates comprise generally parallel planes. The field between the two planes is generally uniform and the average field strength approaches the maximum field strength within the apparatus.

Figure 2:
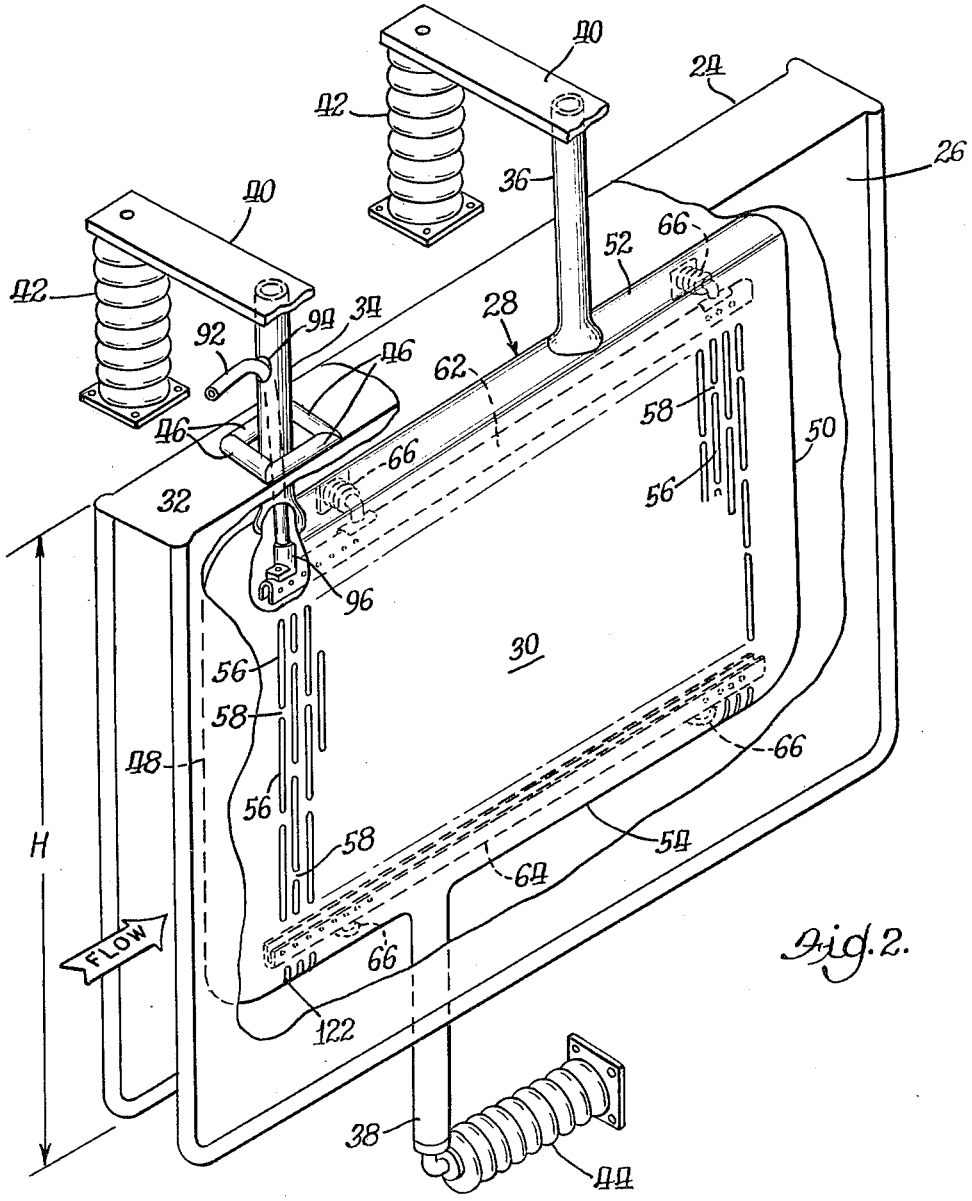
FIG. 2 is a perspective view of the collecting region of the apparatus of the present invention, particularly illustrating the ion generating means which is shown with portions broken away.
Figure 4:
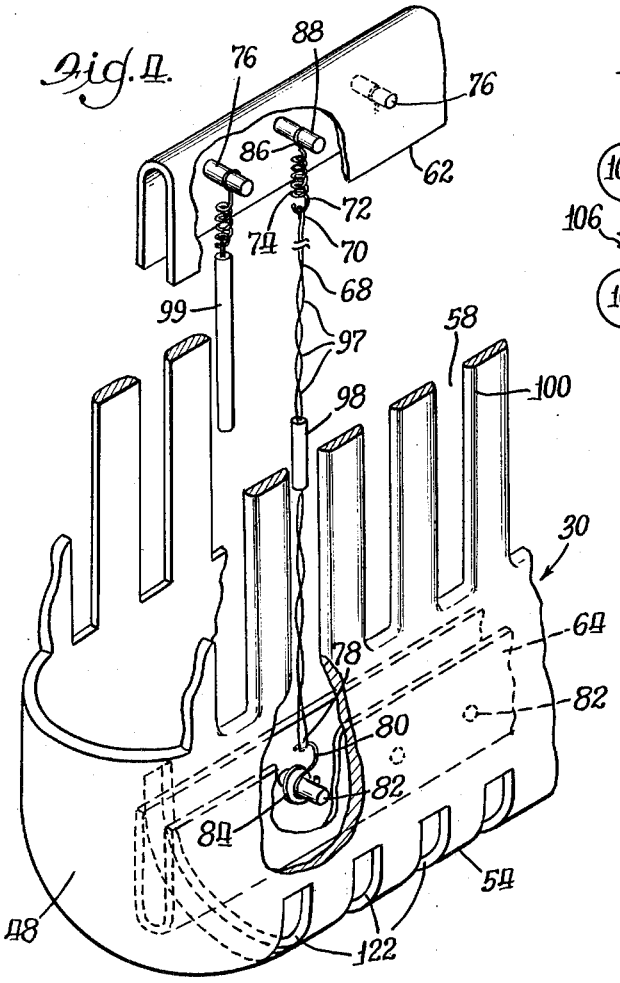
FIG. 4 is an enlarged perspective view of the ion generating means of the apparatus of the present invention, and is shown with portions removed and other portions broken away.

With respect to the construction of the ion generating means 28, reference is made to the perspective view of FIG. 2 which also illustrates the side collecting plates 24 and 26 together with the supporting structure for the generating means and to FIG. 4 which is a perspective view illustrating a portion of the ion generating means. The ion generating means 28 has an outer shell 30 which is preferably charged to a negative potential relative to the side collecting plates 24 and 26 and will hereinafter often be referred to as a cathode. The collecting plates 24 and 26 comprise the plate structure and are preferably positively charged relative to the cathode potential, and are preferably at ground potential. The collecting plates cooperate with the outer shell 30 to provide a uniform high electric field in the channel between the shell 30 and the collecting plates 24 and 26, through which the gaseous medium flows as previously described. While the cathode shell 30 is described herein as being negatively charged with respect to the plate structure, i.e., the collecting plates 24 and 26, it should be understood that the apparatus can be operated with the outer shell positively charged with respect to the plate structure, provided that the corona discharge apparatus located within the shell is also positively charged. It is desirable that the plate structure be maintained at ground potential regardless of whether the corona discharge apparatus and the shell are positively or negatively charged with respect to the plate structure because it is easily accomplished and permits attachment to the main structural framework of the apparatus. The gaseous medium carrying particles that are to be collected therefrom generally passes in the direction shown by the arrow in FIG. 2, i.e., to the right as shown.

The apparatus shown in FIG. 2 may have a height H of 30 feet or more as previously mentioned, and preferably has a generally flat top plate 32 that extends across the entire apparatus, covering the plurality of separate channels, one of which is shown in FIGS. 1–4. The lower end may be open as shown so that the side collecting plates 24 and 26 can be vibrated or rapped to remove the accumulated dust that has been precipitated out of the gaseous medium during operation of the apparatus. The outer shell 30 has a pair of upper cylindrical supports 34 and 36 as well as a lower support 38 for structurally supporting the ion generating means 28 within the channel 16. The upper supports 34 and 36 are attached to respective support members 40 which extend across several channels and are connected to other ion generating means 28 in adjacent channels. The ends of the members 40 are suitably connected to insulators 42 which are preferably made of ceramic and which electrically isolate the members 40 from the remainder of the apparatus.

Similarly, the lower structural cylindrical support 38 is attached to a preferably ceramic insulator 44 that is also suitably connected to the main structre of the apparatus. The net result of the use of the insulators 42 and 44 is to permit the support members 40, cylindrical supports 34, 36, 38 as well as the outer shell 30 to be charged to the desired potential that is preferably negative relative to the collecting plates 24 and 26 as well as the top plate 32. As particularly illustrated with respect to the cylindrical support 34, the top plate 32 has a generally square opening therein through which the cylindrical support passes and each side of the square is preferably provided with a smooth curved surface, such as 2½ inch pipe sections 46 or the like that are welded to the top plate 32 and present a curved surface rather than a sharp edge to prevent sparking between the cylindrical support 34 and the top plate 32. The opening in the top plate 32 adjacent the cylindrical support 36 is preferably provided with similar pipe segments 46. As is best shown in FIG. 2, the outer shell 30 has both the left end portion 48 and right end portion 50, as well as the upper and lower portions 52 and 54 provided with a uniform curvature and the outer shell 30 is shown to be generally solid or closed, except for the presence of a plurality of vertical slots 56 which extend in vertical rows substantially the entire height of the ion generating means 30. The slots have a width of about ½ inch and can be interrupted by web portions 58 of about 2 inches which are provided for the purpose of imparting structural rigidity to the shell 30. As shown, the web portions 58 are offset in adjacent rows for the purpose of insuring that the medium passing by the slots is subjected to an adequate supply of ions which pass from the interior through the slots into the channel. The orientation of the rows of slots is preferably generally vertical as shown in FIGS. 2 and 4, i.e., transverse to the flow of the gaseous medium through the channel 16. This assures that substantially all of the medium is subjected to the ions being injected into the channel as is desired. It should be understood that while the rows of slots are preferably vertically aligned, they may be also oriented at an angle relative to vertical if desired. It should also be understood that while the openings are preferably in the form of elongated slots, the openings can also be circular or some other shape and arranged in rows so that the openings are adjacent the corona discharge members that will be hereinafter described. An important consideration is that the openings, whether in the form of elongated slots, circles, mesh or the like be of a size large enough to pass an adequate supply of ions therethrough, while not significantly disrupting the uniformity of the electric field in the channel.

To generate the ions in the interior of the shell 30, a structure for producing corona discharge is provided and generally comprises upper and lower U-shaped support members 62 and 64 which are suitably connected to the shell 30 or some internal structural member of the shell 30 by electrical insulator supports 66 which electrically isolate the corona discharge structure from the shell to permit the potential differences to be applied to the two structures. The support members 62 and 64 are positioned so that their open sides face one another and corona discharge elements 68 are extended between the two supports, with each element preferably being located in the center of a row of slots 56 so as to provide a supply of ions through corona discharge, the ions being injected into the gaseous effluent through the slots, or through the openings in the mesh in the event a mesh is utilized.

As best shown in FIG. 4, the corona discharge elements 68 preferably comprise thin conducting strips made of any suitable material such as stainless steel and may have a thickness within the range of about 1 to about 5 throusandths of an inch and a width of a few tenths of an inch. The elements can also be thin wire, though the wires have certain disadvantages. An advantage of the thin strips is that the sharp radius at the edge of the strip is more conducive to generating corona discharge than the bigger radius of a wire of comparable strength and longevity in the corrosive environment of the apparatus. The upper end of the strip 68 is doubled back and attached to itself to provide a loop 70 for placement over an open hooked end 72 of a tensioning spring 74 that is in turn attached to an electrically conductive support pin 76 that is attached to the sides of the U-shaped support member 62. Similarly, the lower end of the strip 68 has a loop 78 for placement over a hook member 80 that also is attached to a support pin 82. The hook supports 80 may be centered on the pins 82 by a pair of annular members 84, only one of which is shown in the drawing. By having the hook support 80 sandwiched between the annular members 84 and insuring that the annular members 84 are secured to the pins 82 so that they cannot move, the hook support and therefore the strip 68 can be maintained in the center between the side walls as is desired. At the upper end of the strip 68, the spring 74 is provided with an upper hook 86 which is shown to engage a centered groove 88 in the pin 76, so that the entire strip 68 is properly positioned within the shell. To charge the corona discharge apparatus and referring again to FIG. 2, an electrically insulated cable 92 is provided and is suitably connected to a source of potential (not shown). The cable extends through an opening 94 in one of the cylindrical supports, i.e., the support 34 shown in the drawing, and extends through the interior of it to a suitable electrical connector 96 that is attached to the upper support 62 and thereby provides the potential to the corona discharge producing strips 68.

It is preferred that the corona discharge members 68 have an applied potential that, for fly ash, is within the range of about −40 kV to about −100 kV and preferably about −75 kV and that the outer shell 30 have a voltage level within the range of about −30 kV to about −80 kV and preferably about −60 kV with respect to the potential of the side plates 24 and 26. These voltages may be continuously controlled such as by a feedback loop so as to maintain the electric field within the channel 16 at an optimum level, i.e., as high as possible without experiencing excessive sparking or electrical breakdown or excessive back corona. The level of the field that is attainable within the channel 16 is a function of various conditions, such as the density of the particulates within the gaseous medium, the temperature of the medium and the chemical constituency of the gaseous medium. The voltage may be continously controlled in the manner whereby an optimum sparking rate is experienced, e.g., between about 1 and 20 sparks per minute for a fly ash precipitator section having 100,000 square feet of collecting plate area, so that the efficiency of operation is maximized. In this regard, if the spark rate is below the desired level, the apparatus will not charge the particles as well as it could, and an excessive spark rate causes severe reentrainment and also results in excessive power consumption and reduces the time average field, all conditions indicating less than optimum operating efficiency. The apparatus preferably controls the voltage level by increasing the potential applied to the shell 30 until voltage breakdown or an excessive spark rate is sensed, in which event the voltage is reduced thereafter and slowly increased again while the potential difference between the strips and the shell is held generally constant.

With the respect to the actual corona discharge that is produced in the apparatus, it is highly local phenonmenon that occurs at discrete points along the length of the discharge strip or wire and is highly dependent upon the voltage that is applied thereto. The phenomenon generally occurs as corona spots along the length and the presence of a corona spot produces a space charge at that location and simultaneously reduces the electric field adjacent the spot, thereby discouraging other corona discharging spots immediately adjacent that spot because the field has been reduced. The electric field lines that emanate from dark or noncorona producing regions of the strip or wire will define corresponding dark regions where they terminate on the collecting plates 24 and 26. This is due to the fact that the ions effectively follow field lines and there can therefore only be ions on field lines that emanate from a corona discharging spot. However, the corona pattern, i.e., the intervals between the corona discharging spots can be varied by changing the voltage. If the voltage is increased, the corona discharge spots become closer together and if it is decreased, they move farther apart. At some level of decreased voltage, the corona spots occur rather randomly and significant areas of the collecting plate are starved of pin-on current. Conversely, a high voltage produces a good ion-current coverage of the collecting plates 24 and 26; however, if the associated high current density immediately opposite the corona spots is too high, it can lead to back corona unless the dust layer is exceptionally conductive.

Since it is often necessary to operate the corona discharge apparatus in the present invention at a low current level, the voltage level is relatively low and corona spots occur sparsely along the length of the discharge element 68. To improve the corona pattern, it is preferred that the thin strips be used that the strips be twisted as shown in FIG. 4, preferably at about 6 twists per foot for a width W2 of $3\frac{1}{2}$ inches. By using a twisted strip, the corona discharge spots can be conveniently controlled to those edges of the strip facing the slot. Thus, the use of the twisted discharge strip 68 exhibits corona discharge spots at the locations 97 shown in FIG. 4 in a generally predictable manner, utilizing the voltage levels that have been previously mentioned. This can be further explained with reference to FIG. 3 which is an enlarged, simplified and somewhat exaggerated cross-sectional view of a portion of the apparatus shown in FIG. 2 and showing the slots 58 in the outer shell, and the corona discharge members 68 comprising the twisted strip. The upper strip 68 (nearer the top of the drawing) is oriented so that the edge is centered in the slot and provides a corona discharge spot for generating ions. The lower twisted strip 68 is shown to be at an angle relative to the upper one and the edges are necessarily spaced farther from the shell 30 than when it is oriented as shown by the upper strip 68. The effect can also be characterized as creating alternating areas of high field enhancement and low field enhancement, with the edge being opposed as at locations 97 (FIG. 4) providing high field enhancement and where a flat portion faces the slot comprises areas of low field enhancement. To conserve power in operating the corona discharge strips, a hollow cylinder 98 can be placed around the strip 68 along the length that is opposite the web portions 58 so that corona discharge does not occur where the cylinders are located. This prevents corona discharge from occurring where it would provide no benefit because the ions that would be produced would not reach the channel due to the presence of the web portions 58.

It should of course be appreciated that there will be no corona discharge between adjacent strips 68 regardless of the relative orientations of the twists because all of the strips are at the same potential. In addition to the advantage of using twisted strips 68 to provide well defined corona discharge locations, the twisted strip also eliminates the problem of aligning the strip through its entire length so that the edge is maintained facing the slot as shown by the upper strip 68 in FIG. 3. It should be appreciated that this can be quite troublesome with an untwisted strip considering the thinness of the strip coupled with the length of the strip, which may extend about 30 feet in a commercial fly ash precipitating apparatus. While the twisted strip is preferred for producing the corona discharge within the shell 30, a strip or wire having outwardly extending spikes or points attached to it can be used, with the spikes being strategically placed at preferred spaced locations to provide the desired corona discharge pattern. In this regard, spikes should not be provided on the strip or wire at those locations that are opposite the web portions 58 of the shell for the same reason that the cylinder 98 is attached to the twisted strip, i.e., to reduce inefficient power consumption.

Figure 3:
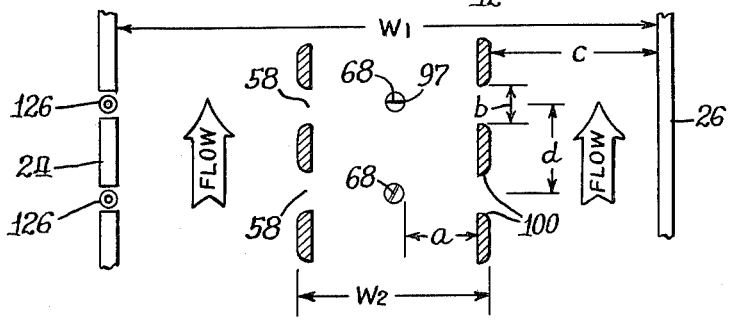
FIG. 3 is an enlarged view of a portion of the apparatus shown in FIG. 2, simplified for the sake of clarity and illustrating the relationship of certain components of the downstream region of the apparatus.

In addition to illustrating the orientation of the edges of the corona discharge strip 68, FIG. 3 is also useful in describing the spatial relationships between the corona discharge strips 68, the cathode shell 30, the slots 58 and the collecting plates 24 and 26. The distance a between the edge of the strip 68 when it is the closest position relative to the slot and the inside of the shell wall is preferably about 1 inch to about 2 inches. With a shell wall thickness of about $\frac{1}{4}$ inch, the distance a of about $1\frac{1}{2}$ inches, the total shell width is about $3\frac{3}{8}$ inches for a strip width of $\frac{1}{8}$ inch. It is preferred that the slot width b be about $\frac{1}{2}$ inch, although it may be as small as about $\frac{1}{8}$ inch or as large as about $\frac{7}{8}$ inch. The distance d between slots is preferably about $1\frac{1}{2}$ inches although a larger or smaller spacing within the range of about 1 inch to about 2 inches can be used. The distance d should be as small as possible without mutual corona spot quenching due to proximity shielding.

It should be appreciated that the mutual shielding provided by the adjacent corona discharge strips does not occur at the endmost strips and that these outer strips will be prone to excessive corona discharge and will consequently provide a high current density that can generate undesirable back corona from the collecting plates 24 and 26. Accordingly, the outer strips should be adequately shielded to reduce the corona discharge thereof to a level comparable to the main body of strips. This is preferably done by placing noncorona discharging bars or cylinders 99 adjacent the end strips as shown in FIG. 4. The bars 99 are charged to the same potential as the strips 68. alternatively, thicker strips having lesser proclivity to corona can be used at the ends so that the resulting corona level is comparable to that of the interior strips.

The outer shell 30 may be made of aluminum, mild steel or the like, and preferably has a thickness of about 1/16 inch to about $\frac{1}{4}$ inch. The outer surface of the shell 30 is preferably curved as shown at 100 because a small radius at the edge of the opening can produce sufficient field distortion to lower the breakdown strength below the optimum. This can occur particularly with a very thin walled shell 30. If the thickness of the shell is only about 1/16 inch, the curved portions or contours 100 may be suitably pressed or deformed for increasing the radius. If the thickness of the shell is too great, the penetration of the extracting electric field into the interior of the shell will be too weak to permit sufficient ion-currrent to be withdrawn. However, it should be understood that when a thick shell wall is used, the corona current can be increased, thereby improving the corona pattern, without incurring excess ion-current density on the side collecting plates 24 and 26, but to do so will result in some waste of power in operating the corona discharge strips 68.

The outer shell may also be a wire mesh construction although the previously described generally continuous shell with slotted openings or the like is preferred. In the event a mesh is used, it should be of a size that does not materially destroy the uniformity of the field or dignificantly inhibit the extraction of ions from the interior of the shell 30. It is also desirable to use a narrow strip, preferably less than about ¼ inch wide, or even corona discharge wires when a mesh is used to ensure full coverage by the ion-current, and with the optimum choice of mesh size, sufficient sideways spreding of the charge on the surface of the duct layer on the collecting plates 24 and 26 should occur and provide sufficient charge pinning over the entire collecting plate area.

As the gaseous medium flows through the downstream region of the apparatus, as shown in FIG. 2, it should be understood that the entrained particles are subjected to ions that are injected into the channel through the rows of openings 56 and the ions will charge any uncharged dust so that it is collected on the side collecting plates 24 and 26. If reentrainment of the particles occurs, then they will again be subjected to ions from downstream rows of slots and be effectively recharged and thereafter precipitated onto the collecting plates in a similar manner. With the considerable number of rows of openings, the downstream portion of the apparatus effectively operates by charging and collecting opposite the slots, and collecting only opposite the shell where ions are not present.

Figure 5:
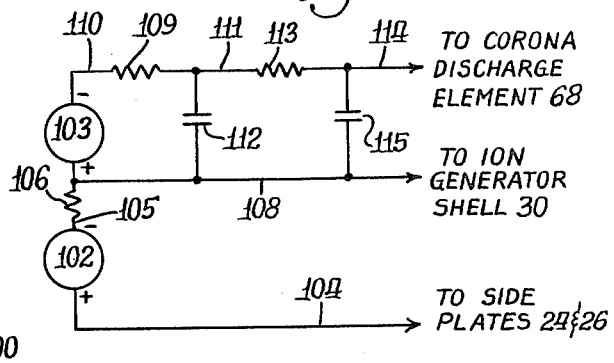
FIG. 5 is a schematic diagram of an exemplary electrical circuit that may be used to charge the corona discharge means as well as the outer shell of the ion generating means of the present invention.

The potential applied to the corona discharge elements 68 and to the ion generating means outer shell can be provided by the circuitry shown in FIG. 5 which includes respective DC power supplies 102 and 103 as shown. The power supply 102 has line 104 connected to the side collecting plates 24 and 26 and are preferably a ground potential. The negative line 105 of the power supply 102 is connected to a current limiting resistor 106 which is also connected to line 108 that extends to the ion generator shell 30 for charging the shell to the desired negative potential about −60 kV with respect to the collecting plates 24 and 26 as previously mentioned. The power supply 104 has its negative side connected to a current limiting resistor 109 via line 110 and the resistor 109 is connected to line 111 that extends to a capacitor 112 and resistor 113. The resistor 113 is connected to the corona discharge elements 68 via line 114 which is also connected to a capacitor 115. The line 114 is connected to the corona discharge elements 68 located within the shell 30 and applies the larger, more negative potential for producing the corona discharge within the shell 30. Although the potential applied to the corona discharge elements 68 is preferably well below that at which sparking occurs, there is an optimum sparking rate between the shell 30 and the collecting plates 24 and 26, and this sparking could induce sympathetic sparking inside the shell the could erode the corona discharge elements 68. However, the resistors 106 and 113 and the capacitors 112 and 115 effectively electrically decouple these two areas which enables an optimal sparking rate to occur outside the shell without inducing sparking within the shell.

In the event that sparking does occur between the corona discharge elements and the shell, it is important that it not develop into an arc. The capacitor 112 together with the resistor 109 serve to quickly quench or extinguish the arc that might occur between the corona discharge elements and the shell 30 and thereby protect the corona discharge elements 68 from being eroded or severed. This is particularly important in the event the thin strips are used as the corona discharge elements, since an arc could sever them relatively easily. The time constant of the resistor 109 and capacitor 112 should also be sufficiently large that restriking of the arc does not occur. In the event the arc quenching circuit is being used in a large fly ash precipitator, the size of the capacitor may be sufficiently large that its discharge upon sparking may itself damage the ccorona discharge elements. This problem can be alleviated by adding inductance to the circuit.

Alternatively, damage to the corona wires in the event of an arc can be alleviated by use of a diverter circuit whereby the power is rapidly diverted by a fast acting switch until slower acting swicthes can interrupt the circuit.

Still another solution to this problem is to supply the corona voltage from a half-wave rectifier so that periods of zero voltage occur naturally to permit any arcs to quench. This solution can be further improved when conditions are particularly bad by selectively switching out more than one half cycle so that the applied half-cycles of voltage occur with larger zero intervals.

Since the gaseous medium carrying the particles that are to be removed passes through the channel 16 adjacent the slots 58, it is desirable to minimize the amount of particle laden medium which enters the slots because the particles accumulate inside the shell 30 and eventually have to be removed. The accumulation of dust on the corona discharge elements 68 also has the undesirable effect of impairing their performance. To remove the particles that do happen to enter the slots, a number of removal slots 122 are provided in the bottom of the shell 30. The corona discharge creates an effect which is often referred to as corona wind that is directed outwardly through the slots or other configured openings and tends to blow the gaseous medium outwardly so that the particles are inhibited from entering the interior of the shell 30. It is preferred that the shell only have openings that are adjacent to corona discharge elements 68, such as shown in FIG. 3, so that the corona wind will be present outwardly through the openings and will thereby inhibit the entry of particles into the interior of the shell. The outward flow through the openings requires replenishing the supply of air or fluid within the shell, and, accordingly, the interior of the shell may be connected to a supply of clean gas or air, which may be provided via the cylindrical supports.

The supply of relatively clean air may also be provided by using the downstream medium flowing through the channel if desired. Since the medium will be significantly cleaner at the downstream end, i.e., the rightward portion of the channel shown in FIG. 2, additional openings near the right end 50 may be provided to allow the clean medium to enter and replenish the fluid that flows outwardly through the slots 56.

Alternatively, the inside of the shell may be provided with a supply of clean air that has a positive pressure relative to that of the channel 16 so that a more pronounced outward flow of clean gas or air through the slots exists, which would also inhibit the gaseous medium from entering the slots. The volume of clean air required would of course depend upon the number of rows of slots or openings that are present as well as the overall size of the openings. Even though the above techniques can be used to inhibit the particles from entering the openings or slots, it is most difficult to absolutely prohibit particles from doing so. Thus, rapping or vibrating the shell 30 may conveniently be utilized to remove the accumulated particles through the lower openings 122.

To reduce the problem of back corona between the collecting plates 24 and 26 and the shell 30, the resistivity of the dust particles that accumulate on the side plates 24 and 26 may be lowered. With the row of slots shown in FIG. 2, the resistivity of the accumulated particles may need to be lowered only in localized areas opposing the slots where back corona will most likely occur. Lowering the resistivity of the dust particles can be achieved in different ways, i.e., when the dust is fly ash, the resistivity of the dust layer can be lowered by introducing a fluid, such as steam, sulfur trioxide, ammonia or the like or by heating or cooling the collecting plate structure since the resistivity of the dust has a maximum value at about 300° F., which is close to typical operating temperatures of fly ash effluent gas.

Referring to FIG. 3, a modification of the apparatus may include a number of tubes, such as the tubes 126 positioned in the side collecting plate 24 opposite the openings 58. The edge of each of the tubes is preferably aligned with the surface of the collecting plate 24 so that the general plane of the side plate is not appreciably changed which can affect the uniformity of the electric field. Tubes 126 are preferably made of sintered brass or other material that can withstand rapping as well as the chemical environment posed by the medium which is being put through the precipitator, and also be sufficiently porous that the steam, sulfur trioxide, ammonia or the like can be transmitted through the wall thereof. Dampening the tubes opposite the slots by means of steam has been found to reduce the occurrence of undesirable back corona, particularly at the voltage levels from the shell that have been described herein. The tubes 126 may be interconnected to one another or connected to a common manifold that is in turn connected to a source of the steam or the like and, in this regard, it is preferred that the manifold not be porous that the fluid will only be transmitted through the porous walls of the tubes that are located in the collecting plate.

To prevent back corona when the tubes 126 are not utilized, it is important that the maximum current density on the collecting plates 24 and 26 be limited to a few hundred nanoamps/cm$^2$ and perhaps as little as a very few tens of nanoamps/cm$^2$ with very high resistivity particulates.

Figure 7:
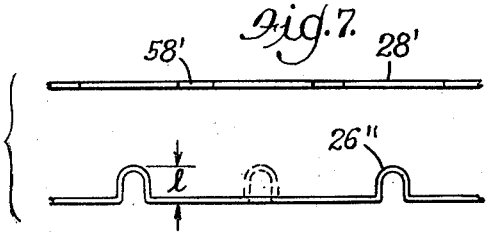
FIG. 7 is an enlarged simplified plan view of a portion of the apparatus shown in FIG. 6.
Figure 6:
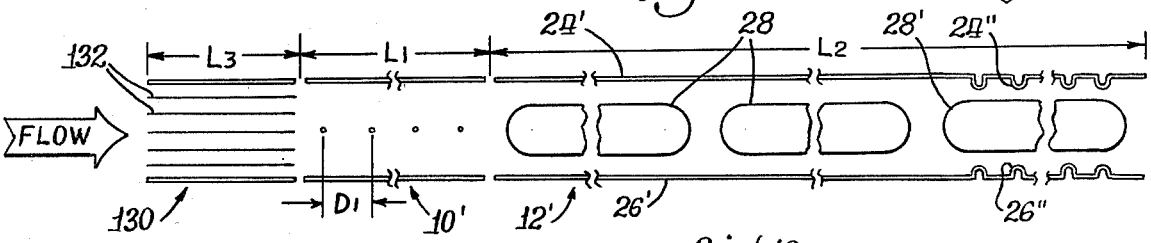
FIG. 6 is a simplified schematic plan view of a modification of the precipitation apparatus which also embodies the present invention.

In accordance with another aspect of the present invention, a modification thereof is shown in FIG. 6 and includes an upstream precipitator region 10', a downstream precipitator 12' having the ion generating means 28 therein, including a final downstream ion generating means 28'. The collecting plates 24' and 26' have a section 24'' and 26'' adjacent the final ion generating means 28' which are vertically ribbed as shown in FIG. 6 as well as in the enlarged view of FIG. 7. The ribs on the collecting plates 24'' and 26'' are spaced apart a distance equal to an integral number of times the distance between the slots 58', and are positioned so as to face the shell 28' along lines lying midway between selected adjacent slots 58' to produce quiescent zones immediately adjacent the collecting plates 24' and 26' so that the particles that are accumulated thereon will be more likely to fall below when the side plate is rapped or vibrated and there will be less reentrainment of the particles into the medium. Since the final stage represents the last opportunity for removing the particles before it reaches the outlet of the apparatus, any particles that are reentrained in this section will be lost. The height l of the ribs (see FIG. 7) is preferably within the range of about $\frac{1}{4}$ to $\frac{1}{2}$ inch. Since the ribs in the side plates effectively reduce the uniformity of the electric field that is present between the ion generating means 28' and the side collecting plates, the potential applied to the ion generating means may have to be reduced.

Another solution to the problem of reentrainment of particles into the medium when the collecting plates 24 and 26 are rapped or vibrated is to provide a separate, additional precipitator section formed of one or more corona wires and associated collecting plate or plates, generally similar to that provided in the upstream region 10, located downstream of the ion generating means 28 to recharge and recollect any such reentrained particles.

Ahead of the upstream region 10' is a gravitational precipitator 130 which is provided to utilize gravitational force to provide fall-out of the larger particles before they reach the electrical precipitators. In this regard, reference is made to FIGS. 8 and 9 which show the upstream region 10' in addition to the gravitational precipitator section 130, with the section 130 comprising a series of spaced apart inclined plate members 132 that present a plurality of surfaces upon which the particles can collect.

Figure 8:
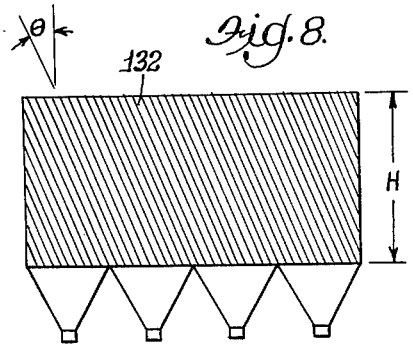
FIG. 8 is a simplified front view of yet another modification of the present invention, particularly illustrating a gravitational pre-precipitator.
Figure 9:
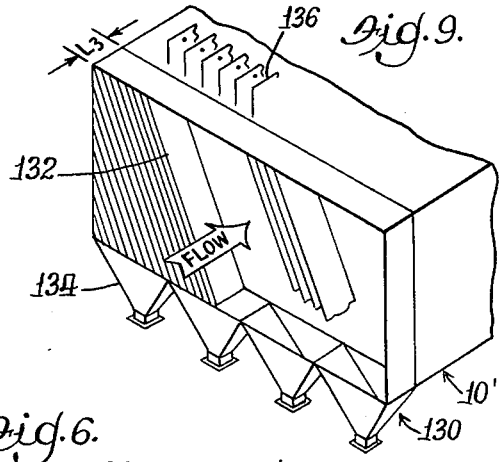
FIG. 9 is a perspective view of the gravitational preprecipitator modification shown in FIG. 8, and also illustrating a portion of the upstream region of the precipitating apparatus.

It should be appreciated that a commercial apparatus for use in fly ash precipitation may have a height H of 30 feet or more and that the possibility of effectively utilizing gravitational fall-out is remote unless the inclined members are used. By orienting the members at an angle $\theta$ of about 15° to about 30° from vertical, the gravitational fall-out can be achieved and yet permit vibrating or rapping to cause the particles to fall into receiving hoppers 134. While the length L3 of the precipitator section 130 may vary, it is preferably about 4 feet. As shown in FIGS. 8 and 9, the precipitator section 130 is provided with a number of the receiving hoppers 134 and the drawing is shown in conjunction with a plurality of channels, the plates 136 being the side plates of adjacent channels as previously described with respect to FIGS. 1 and 6. the inclined plates 132 may also be fabricated to have outer conductive layers and an insulating material therebetween. The layers of the plates on which the particulates fall can be negatively charged and the other layers of the plates can be positively charged so that an electric force acting in the same direction as the gravitational force can influence the particles downwardly since they have been shown to acquire a positive charge triboelectrically ahead of the precipitator. In this regard, the electric field should be relatively small so that the previously mentioned bouncing phenomenon is not experienced. It is intended that the electric field force merely supplement the gravitational force in removing the larger particles.

Alternatively, a conventional cyclone precipitating unit which utilizes centrifugal forces for particle removal may be used ahead of the electrical precipitators for the purpose of removing the larger particulates.

Figure 10:
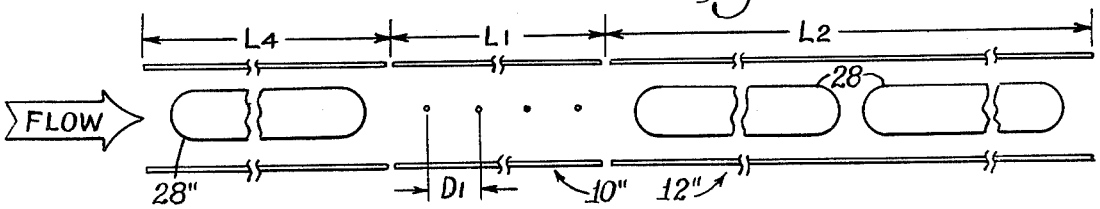
FIG. 10 is a simplified schematic plan view illustrating yet another modification of the apparatus of the present invention, and particularly illustrating an electrical preprecipitator for collecting large particles.

Yet another modification of the apparatus is shown in FIG. 10 and includes an ion generating means 28″ located ahead of an upstream section 10″ and the ion generating means 28″ is preferably charged to a lower potential than the downstream region and is intended to remove large particles before they reach the upstream region 10″. In this regard, the use of an ion generating means 28″ may provide an electric field that is less than about 1 kV/cm so that the force that is exerted on the large particles will not be excessive and will not produce the bouncing effect previously discussed. It is also contemplated that a separate, additional section of corona discharge wires similar to the upstream region 10 be provided ahead of the upstream region, with the electric field in this section being substantially lower than in the upstream region, for the same reasons.

It should be understood from the foregoing detailed description that an improved precipitating apparatus has been shown and described which achieves reliable operation at efficient power levels. The downstream region with its ion generating means is of superior design which, when used with the upstream region, results in the removal of particles at rates that have not been heretofore possible.

It should be understood that while certain preferred embodiments of the present invention have been illustrated and described, various modifications thereof will become apparent to those skilled in the art, and, accordingly, the scope of the present invention should be defined only by the appended claims and equivalents thereof.

Various features of the invention are set forth in the following claims.

What is claimed is:

1. A multi-stage system for removing particles from a gaseous medium carrying the same, comprising:

a flow channel through the system through which the gaseous medium passes in a downstream direction;

a first precipitating stage within said channel comprising an electrostatic precipitator of the type which has at least one charged wire within said channel for producing a corona discharge for charging particles within the gaseous medium, and at least one collecting plate spaced from said wire for collecting the charged particles;

a second precipitating stage within said channel, said second stage being located only downstream of said first stage and comprising at least one conductive shell means, each shell means having a corona discharge means located therewithin, adjacent collecting plate means associated with and spaced from each said shell means, the space between said shell means and said associated collecting plate means defining a pathway within said channel through which the medium passes, said shell means being spaced and charged to a sufficient potential to maintain a strong generally uniform electric field between each of said shell means and said associated collecting plate means, each of said shell means having a plurality of openings therein through which ions generated by said corona discharge means can pass and enter said pathway to charge the particles within the medium, said openings being sufficiently large to pass enough ions therethrough to charge the particles while not being so large so as to significantly disrupt the generally uniform electric field, said electric field driving said charged particles toward said associated collecting plate means where they are collected thereon.

2. A system as defined in claim 1 wherein said first stage has at least three parallel collecting plates generally aligned in the direction of flow of the medium passing therethrough, and separate sets of charged wires located between adjacent collecting plates.

3. A system as defined in claim 1 wherein said second stage includes two at least of said shell means serially located within said channel.

4. A system as defined in claim 1 wherein said second stage includes two at least of said shell means located within said channel parallel to one another, and one of said plate means located between each pair of parallel positioned shell means.

5. A system as defined in claim 1 wherein said second stage includes two at least of said shell means located within said channel, at least two of said shell means being generally in the same plane and positioned at the same location in said channel relative to the direction of flow of the medium through the channel.

6. A system as defined in claim 1 wherein said corona discharge means comprises a plurality of corona discharge members located within said shell means and secured at opposite end portions thereof, said members being electrically insulated from said conductive shell means so that they can be charged to a potential different from the potential applied to said shell means.

7. A system as defined in claim 6 wherein said shell means has two generally flat side portions generally parallel to one another, and top, bottom, front and end portions which are curved to smoothly merge with said side portions.

8. A system as defined in claim 7 wherein said shell means comprises a structurally rigid electrically conductive material.

9. A system as defined in claim 8 wherein the openings in said shell means are arranged in rows that are oriented in a direction generally transverse to the direction of flow of said medium passing through said pathway.

10. A system as defined in claim 9 wherein at least one of said corona discharge members is located adjacent each of said rows of openings, so that ions produced by said members pass through the openings of the adjacent associated row.

11. A system as defined in claim 9 wherein said openings comprise elongated slots, the ends of which are separated by web portions of said shell means.

12. A system as defined in claim 11 wherein the web portions between adjacent slots of a row are offset relative to web portions of adjacent rows.

13. A system as defined in claim 9 wherein said elongated openings have a width within the range of about $\frac{1}{8}$ inch to about $\frac{7}{8}$ inch.

14. A system as defined in claim 9 wherein the spacing between centers of adjacent rows is within the range of about 1 inch to about 2 inches.

15. A system as defined in claim 8 wherein siad shell means comprises steel or aluminum having a thickness within the range of about 1/16 inch to about $\frac{1}{4}$ inch.

16. A system as defined in claim 8 wherein additional openings are located in said bottom portion of said shell means to permit particulates that accumulate inside of said shell means to be removed therefrom.

17. A system as defined in claim 7 wherein said corona discharge members comprise thin wires.

18. A system as defined in claim 7 wherein said corona discharge members comprise thin electrically conductive strips having a width substantially greater than the thickness thereof.

19. A system as defined in claim 18 wherein said conductive strips are twisted along their length to present uniformly spaced edge length portions that are relatively closer to said shell means, said presented edge length portions experiencing electrical field enhancement relative to the portions of the strip intermediate said presented edge length portions, said edge length portions exhibiting corona discharge at desired locations generally uniformly spaced along the length of the strip.

20. A system as defined in claim 6 wherein said shell means comprises an electrically conductive wire mesh construction, the spacing between wires of said mesh defining said openings.

21. A system as defined in claim 6 wherein said corona discharge members located within said conductive shell means are positioned therein so that they are spaced within the range of about 1 inch to about 2 inches from said shell means.

22. A system as defined in claim 6 wherein said members located on opposite ends of said plurality of members are of increased cross-sectional size and are free from any sharp edges to reduce their proclivity to corona discharge relative to interior ones of said plurality of said members to thereby compensate for the absence of mutual shielding produced by adjacent members located on both sides thereof.

23. A system as defined in claim 1 wherein said corona discharge means located inside of said conductive shell means is charged to an electrical potential within the range of about −40 kV to about −100 kV and said shell means is charged to a potential within the range of about −30 kV to about −80 kV relative to said associated collecting plate means.

24. A system as defined in claim 1 wherein said corona discharge means located inside of said conductive shell means is charged to an electrical potential within the range of about 40 kV to about 100 kV and said shell means is charged to a potential within the range of about 30 kV to about 80 kV relative to said associated collecting plate means.

25. A system as defined in claim 1 wherein said associated plate means is spaced from said shell means a predetermined distance within the range of about 1 inch to about 4 inches.

26. A system as defined in claim 1 wherein said plate means of said second stage includes a porous member located opposite at least one of said openings, said member being provided with a fluid which can pass through the porous member and reduce the resistivity of the particles collected thereon and thereby reduce the possibility of back corona.

27. A system as defined in claim 26 wherein said porous member comprises hollow porous tubing through which fluid is transmitted, the exposed portion of said tubing being generally in the same plane as said wall means.

28. A system as defined in claim 27 wherein said porous tubing comprises sintered metal.

29. A system as defined in claim 1 wherein said wires of said first stage have a potential applied thereto relative to said plate means to provide a mean electric field strength of about 4 kV/cm.

30. A system as defined in claim 1 wherein at least the downstream portion of the collecting plate means associated with said conductive shell means includes a plurality of vertical ribs extending inwardly towards said shell means to minimize the reentrainment of particles back into the gaseous medium.

31. A system as defined in claim 1 further including a third precipitating stage located upstream of said first stage, said third stage comprising precipitating means of the type which utilizes nonelectrical forces to remove larger particles from said medium before the medium reaches said first stage.

32. A system as defined in claim 1 further including a third precipitating stage located upstream of said first stage and being of the type which electrically charges the particles within said medium and which utilizes an electric field for driving the charged particles toward a collecting plate, the strength of the electric field of said third stage being substantially less than the electric field provided in either of said first and second stages.

33. A system as defined in any of claims 1 through 30 further including a third precipitating stage located upstream of said first stage, said third stage comprising precipitating means of the type which utilize centrifugal force for separating particles from said medium.

34. A system as defined in any of claims 1 through 30 further including a third precipitating stage located upstream of said first stage, said third stage comprising precipitating means of the type in which particles are removed from the medium by settling out of the medium onto at least one receiving surface due to gravitational forces acting thereon.

35. A system as defined in any of claims 1 through 30 further including a third precipitating stage located upstream of said first stage, said third stage comprising an electrostatic precipitator of the type which has one or more charged wires spaced from one another for producing a corona discharge for charging particles within the gaseous medium, and at least one collecting plate spaced from said wires for collecting the charged particles.

36. A system as defined in any of claims 1 through 30 further including a third precipitating stage located upstream of said first stage, said third stage comprising one or more conductive shell means, each shell means having a corona discharge means located therewithin, adjacent plate means associated with and spaced from each said shell means, the space between said shell means and said associated plate means defining a pathway within said channel through which the medium passes, said shell means being spaced and charged to a sufficient potential to maintain a uniform electric field between each of said shell means and said associated plate means, each of said shell means having a plurality of openings therein through which ions generated by said corona discharge means can pass and enter the pathway to charge the particles within the medium, said openings being sufficiently large to pass enough ions therethrough to charge the particles while not being so large so as to significantly disrupt the generally uniform electric field, said electric field driving said charged particles toward the associated plate means where they are collected thereon.

37. A system as defined in any of claims 1 through 32 including a further precipitating stage located downstream of said second stage and comprising an electrostatic precipitator of the type which has one or more charged wires spaced from one another within said channel for producing a corona discharge for charging particles within the gaseous medium, and at least one collecting plate spaced from said wires for collecting the charged particles.

* * * * *